US007222697B2

(12) United States Patent
Chen

(10) Patent No.: US 7,222,697 B2
(45) Date of Patent: May 29, 2007

(54) ELEVATOR

(76) Inventor: Chih Chen, 4250 Claremont Dr., Grand Prairie, TX (US) 75052

( * ) Notice: Subject to any disclaimer, the term of this patent is extended or adjusted under 35 U.S.C. 154(b) by 133 days.

(21) Appl. No.: 11/075,732

(22) Filed: Mar. 10, 2005

(65) Prior Publication Data

US 2006/0201749 A1 Sep. 14, 2006

(51) Int. Cl.
*B66B 11/08* (2006.01)

(52) U.S. Cl. ..... 187/263; 187/261; 187/251; 182/144; 182/148; 182/150; 254/266; 254/375

(58) Field of Classification Search ..... 187/254, 187/261–266, 348, 414; 254/4 C, 266, 278, 254/325, 375; 242/266, 385, 390, 391; 182/12, 182/14, 16, 144, 147, 148, 150
See application file for complete search history.

(56) References Cited

U.S. PATENT DOCUMENTS 373,114 A * 11/1887 Merrill et al. ..... 187/266
3,915,432 A * 10/1975 Bustamante ..... 182/239
4,624,097 A * 11/1986 Wilcox ..... 57/232
2005/0217944 A1* 10/2005 Aulanko et al. ..... 187/266

* cited by examiner

*Primary Examiner*—Gene O. Crawford
*Assistant Examiner*—Stefan Kruer
(74) *Attorney, Agent, or Firm*—Lowe Hauptman & Berner, LLP

(57) ABSTRACT

An elevator is described, comprising a first series connected pulley set installed in a fixing frame, a carriage located below the first series connected pulley set, a second series connected pulley set installed on the top of the carriage, a rotary wheel installed in the carriage and a steel rope. The steel rope connects the first series connected pulley set, the second series connected pulley set and the rotary wheel, so that the gravity load of one pulley set can belowered to decrease the pulling force of the steel rope to enhance the safety of the elevator.

10 Claims, 2 Drawing Sheets

ELEVATOR

FIELD OF THE INVENTION

The present invention relates to an elevator, and more particularly, to an elevator including multiple pulley sets.

BACKGROUND OF THE INVENTION

With the rapid development of industry and commerce, a large population migrates to cities. In order to meet the inhabitation need, the buildings in city are prompted to be higher and higher. Since the stories of buildings are inevitably increasing, elevators have become the essential installations of high buildings for the convenience of the users in the buildings.

Since elevators have become the essential installations for shuttling between stories, the utility rate has reached a high position. Furthermore, with the increase of building height as well as the close relation between the safety of elevators and the safety of individuals, the safety of elevators has become even more important.

SUMMARY OF THE INVENTION

Therefore, one objective of the present invention is to provide an elevator including a plurality of series connected pulley sets, so that the gravity load of one pulley set can be lowered to decrease the pulling force of a steel rope, and the rotary torque force of a rotary wheel within the elevator can be reduced.

Another objective of the present invention is to provide an elevator, in which a rotary wheel, a carriage and pulley sets installed on the carriage are integrated, so that the whole carrying load of the elevator can be absorbed by the rotary wheel.

Still another objective of the present invention is to provide an elevator, in which a rotary wheel of the elevator includes a reverse-proof device and a hand brake device, and the elevator is a of multi-lines hoisting design, so that when one of the steel ropes is snapped, the other of the steel ropes can work separately to enhance the safety.

Further another objective of the present invention is to provide an elevator suitable for applying in fire-fighting equipments, so as to solve the problem of narrow range of the firefighter's tower ladder to save life in an emergency.

According to the aforementioned objectives, the present invention provides an elevator, comprising: a first series connected pulley set installed in a fixing frame, in which the first series connected pulley set comprises a first pulley fixing frame and a plurality of first pulleys installed in the first pulley fixing frame, the first pulleys have different sizes, and the first pulleys are arranged in sizes from top to bottom; a carriage located below the first series connected pulley set; a second series connected pulley set installed on the top of the carriage and corresponding to the first series connected pulley set, in which the second series connected pulley set comprises a second pulley fixing frame and a plurality of second pulleys installed in the second pulley fixing frame, the amount of the second pulleys is the same with that of the first pulleys, the second pulleys have different sizes, and the second pulleys are arranged in sizes from bottom to top; a rotary wheel installed in the carriage; and a steel rope connecting the first series connected pulley set, the second series connected pulley set and the rotary wheel, in which one end of the steel rope is fixed to the first pulley fixing frame, the steel rope alternately connects the second pulleys and the first pulleys from the smallest one of the second pulleys to the largest one of the first pulleys by using the end of the steel rope fixed to the first pulley fixing frame as a beginning and a outward spiral method, and the other end of the steel rope is connected to the rotary wheel.

According to the aforementioned objectives, the present invention provides an elevator, comprising: a first upper pulley set, in which the first upper pulley set comprises a plurality of first upper pulleys installed side by side in a fixing frame; a second upper pulley set located beside one side of the first upper pulley set, in which the second upper pulley set comprises a plurality of second upper pulleys installed side by side in the fixing frame; a carriage located below the first upper pulley set and the second upper pulley set; a first lower pulley set corresponding to the first upper pulley set, in which the first lower pulley set comprises a plurality of first lower pulleys installed side by side on a top of the carriage, and the amount of the first lower pulleys is the same with that of the first upper pulleys; a second lower pulley set located beside the first lower pulley set and corresponding to the second upper pulley set, in which the second lower pulley set comprises a plurality of second lower pulleys installed side by side on the top of the carriage, and the amount of the second lower pulleys is the same with that of the second upper pulleys; a rotary wheel installed in the carriage, in which the carriage comprises a partition member to divide the rotary wheel into a first reel region and a second reel region; a first steel rope connecting the first upper pulleys, the first lower pulleys and the rotary wheel, in which one end of the first steel rope is fixed to the fixing frame beside the other side of the first upper pulley set, the first steel rope alternately connects the first lower pulleys and the first upper pulleys from the closest one of the first lower pulleys by using the end of the first steel rope fixed to the fixing frame as a beginning, and the other end of the first steel rope is connected to the first reel region of the rotary wheel; and a second steel rope connecting the second upper pulleys, the second lower pulleys and the rotary wheel, in which one end of the second steel rope is fixed to the fixing frame beside one side of the second upper pulley set far away from the first upper pulley set, the second steel rope alternately connects the second lower pulleys and the second upper pulleys from the closest one of the second lower pulleys by using the end of the second steel rope fixed to the fixing frame as a beginning, and the other end of the second steel rope is connected to the second reel region of the rotary wheel.

According to a preferred embodiment of the present invention, the rotary wheel further comprises a reverse-proof device and a hand brake device.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention discloses an elevator, which can reduce the gravity load and the pulling force of a steel rope, and the elevator can achieve superior safety performance. In order to make the illustration of the present invention more explicit and complete, the following description is stated with reference to FIGS. 1 and 2.

Figure 1:
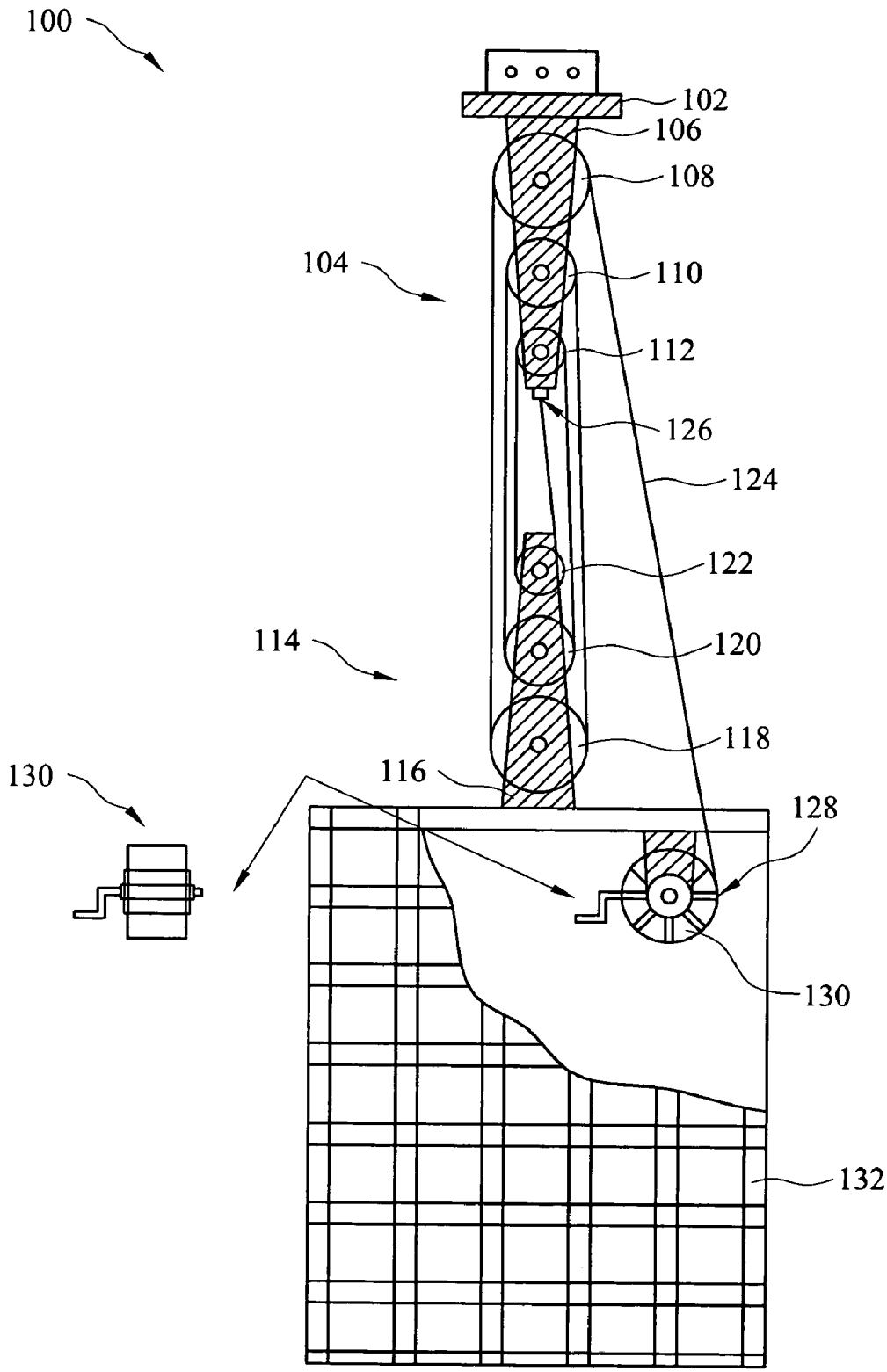
FIG. 1 is a schematic diagram showing an elevator in accordance with a preferred embodiment of the present invention.

FIG. 1 is a schematic diagram showing an elevator in accordance with a preferred embodiment of the present invention. An elevator 100 is of a single-line hoisting design. The elevator 100 is mainly composed of a pulley set 104, a pulley set 114, a carriage 132, a rotary wheel 130, and a steel rope 124. The pulley set 104 is installed in a fixing frame 102, in which the pulley set 104 is composed of a pulley fixing frame 106, a pulley 108, a pulley 110 and a pulley 112, and the pulley 108, the pulley 110 and the pulley 112 are fixed in the pulley fixing frame 106 in series. The pulley 108, the pulley 110 and the pulley 112 have different sizes, in which the pulley 108 is the larger while the pulley 112 is the smallest. The pulley 108, the pulley 110 and the pulley 112 are series connected in sizes from top to bottom, i.e. the pulley 108 is at the top, the pulley 110 is in the middle and the pulley 112 is at the bottom.

The carriage 132 is located below the pulley set 104, in which one side surface of the carriage 132 is set with a movable door (not shown) as the entrance for people and goods. The rotary wheel 130 is installed in the carriage 132, in which the rotary wheel 130 is fixed to the underneath of a top plate of the carriage 132. The rotary wheel 130 is an important component of the elevator 100, and the rising and the descending of the elevator 100 can be controlled by operating the rotary wheel 130. In a preferred embodiment of the present invention, the rotary wheel 130 is set with a reverse-proof device (not shown) to prevent the rotary wheel 130 from reversing caused by gravity, thereby avoiding the elevator 100 descending unexpectedly. The rotary wheel 130 may be additionally set with a hand brake device (not shown) for further protection.

The pulley set 114, which is corresponding to the pulley set 104, is fixedly installed on the upper side of the top plate of the carriage 132, in which the amount of the pulleys of the pulley set 114 is the same with that of the pulleys of the pulley set 104. The pulley set 114 is composed of a pulley fixing frame 116, a pulley 118, a pulley 120 and a pulley 122, in which the pulley 118, the pulley 120 and the pulley 122 are fixed in the pulley fixing frame 116 in series. The pulley 118, the pulley 120 and the pulley 122 have different sizes, in which the pulley 118 is the larger while the pulley 122 is the smallest. Contrary to the pulley set 104, the pulley 118, the pulley 120 and the pulley 122 are series connected in sizes from bottom to top, i.e. the pulley 122 is at the top, the pulley 120 is in the middle and the pulley 118 is at the bottom.

The pulley set 104, the pulley set 114 and the rotary wheel 130 are connected by the steel rope 124, in which the steel rope 124 has a plastic cover. A front end 126 of the steel rope 124 is fixed to the pulley fixing frame 106, the steel rope 124 alternately connects the pulleys of the pulley set 114 and the pulley set 104 from the pulley 122, which is the smallest one in the pulley set 114, to the pulley 108, which is the largest one in the pulley set 104 by using the front end 126 of the steel rope 124 as a beginning and an outward spiral method, and a rear end 128 of the steel rope 124 is connected to the rotary wheel 130, i.e. the steel rope 124 is extended downward to connect the pulley 122 from the pulley fixing frame 106, next upward to connect the pulley 112, then downward to connect the pulley 120, subsequently upward to connect the pulley 110, next downward to connect the pulley 118, and then upward to connect the pulley 108. Afterward, the rear end 128 of the steel rope 124 is connected to the rotary wheel 130. Therefore, the rotary wheel 130 can be driven by the steel rope 124 to hoist or descend the elevator 100.

Each of the pulley set 104 and the pulley set 114 includes three pulleys, so the steel rope 124 is divided into six hoisting portions between the pulley set 104 and the pulley set 114. The load of the elevator 100 are equally shared out between the six hoisting portions, so that the gravity load and the pulling force of the steel rope 124 can be decreased, and the torque force of the rotary wheel 130 can be reduced, thereby achieving the effect of increasing a safety factor of the elevator 100.

In an embodiment, a diameter of the steel rope 124 is about 3/16 inch, the load-carrying limitation of each hoisting portion of the steel rope 124 is up to 475 kilograms, and there are six hoisting portions in the elevator 100 to share the whole carrying load, so the pulley apparatus of the present embodiment can bear a total of 2850 kilograms. Provided that a 160-kilogram load is carried, and the amount weight of the pulley set 104, the pulley set 114, the carriage 132 and the rotary wheel 130 is 100 kilograms, that is the pulley apparatus has to bear a total load of 260 kilograms, the safety factor of the elevator 100 will be over 10 times.

In the present invention, the amount of the pulleys of the pulley set 104 and the pulley set 114 is not limited to the aforementioned embodiment and can be adjusted according to practical needs.

Figure 2:
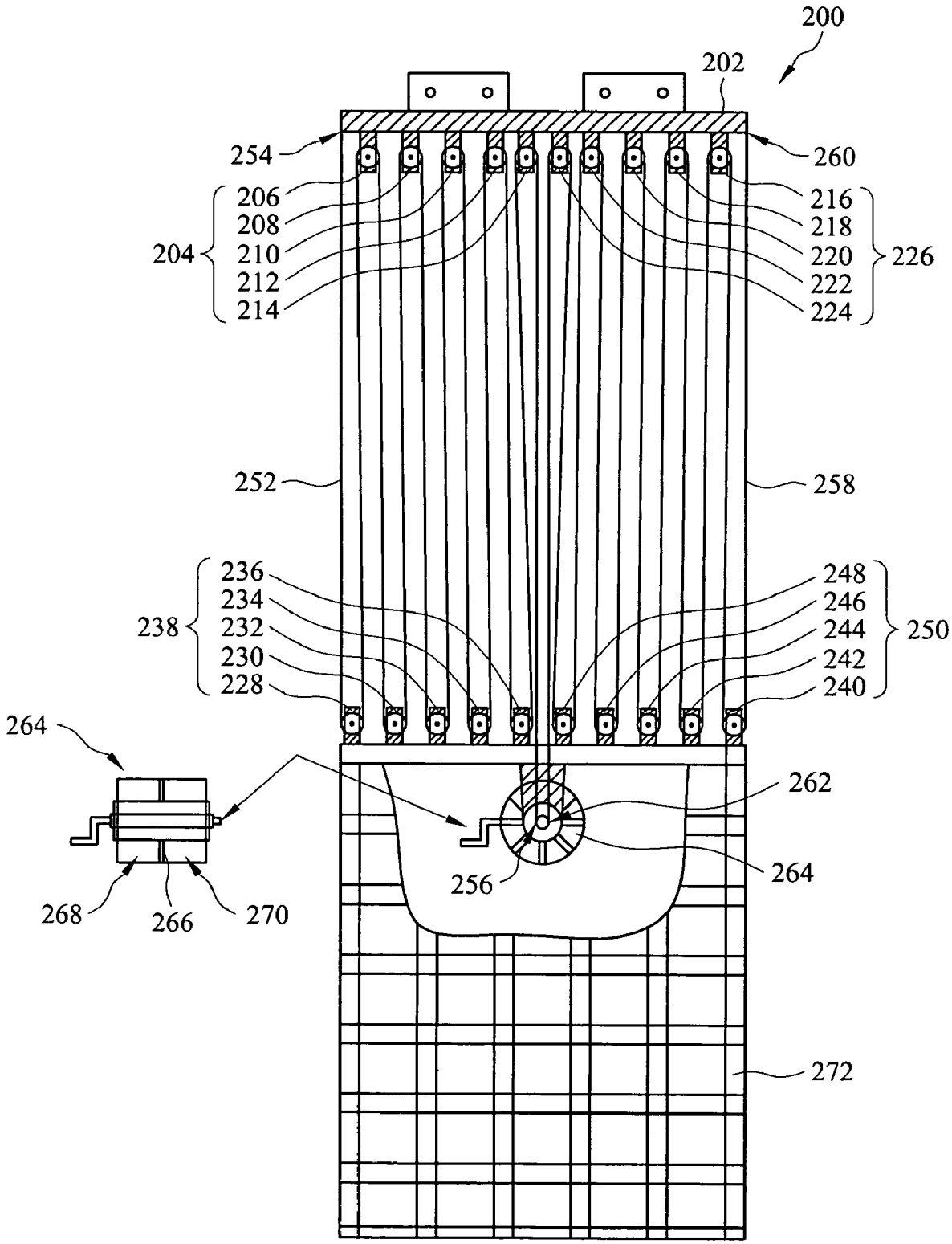
FIG. 2 is a schematic diagram showing an elevator in accordance with another preferred embodiment of the present invention.

FIG. 2 is a schematic diagram showing an elevator in accordance with another preferred embodiment of the present invention. An elevator 200 is of dual-lines hoisting design, in which the elevator 200 is mainly composed of a pulley set 204, a pulley set 226, a pulley set 238, a pulley set 250, a carriage 272, a rotary wheel 264, a steel rope 252 and a steel rope 258. The pulley set 204 is composed of a pulley 206, a pulley 208, a pulley 210, a pulley 212 and a pulley 214 side by side fixed to a fixing frame 202. The pulley set 226 is installed to the fixing frame 202 beside the pulley set 204, in which the pulley set 226 is composed of a pulley 216, a pulley 218, a pulley 220, a pulley 222 and a pulley 224 side by side fixed to the fixing frame 202.

The carriage 272 is located below the pulley set 204 and the pulley set 226, in which one side surface of the carriage 272 is set with a movable door (not shown) as the entrance for people and goods. The rotary wheel 264 is installed in the carriage 272, in which the rotary wheel 264 is fixed to the underneath of a top plate of the carriage 272. The rotary wheel 264 is an important component of the elevator 200, and the rising and the descending of the elevator 200 can be controlled by operating the rotary wheel 264. A partition member 266 is installed in the rotary wheel 264 to divided the rotary wheel into a reel region 268 and a reel region 270, so as to prevent the steel ropes from entwining with each other. In a preferred embodiment of the present invention, the rotary wheel 264 is set with a reverse-proof device (not shown) and a hand brake device (not shown), in which the reverse-proof device can prevent the rotary wheel 264 from reversing caused by gravity to avoid the elevator 200 descending unexpectedly, and the hand brake device is provided for further protection.

The pulley set 238 is composed of a pulley 228, a pulley 230, a pulley 232, a pulley 234 and a pulley 236 side by side fixed to an upper side of a top plate of the carriage 272, in which the amount of the pulleys of the pulley set 238 is the same with that of the pulleys of the pulley set 204, and the pulley set 238 is corresponding to the pulley set 204. The pulley set 250 is installed on the upper side of the top plate of the carriage 272 beside the pulley set 238, in which the pulley set 250 is composed of a pulley 240, a pulley 242, a pulley 244, a pulley 246 and a pulley 248 side by side fixed to the carriage 272, the amount of the pulleys of the pulley set 250 is the same with that of the pulleys of the pulley set 226, and the pulley set 250 is corresponding to the pulley set 226.

It is worthy of note that the amount of the pulleys of the pulley set 204, the pulley set 226, the pulley set 238 and the pulley set 250 is not limited to the aforementioned description and can depend on practical needs. In the present invention, it is only to make the pullet set 204 and the corresponding pullet set 238 have the same amount of the pulleys, and the pullet set 226 and the corresponding pullet set 250 have the same amount of the pulleys.

The pulley set 204, the pulley set 238 and the rotary wheel 264 are connected by the steel rope 252, in which the steel rope 252 has a plastic cover. A front end 254 of the steel rope 252 is fixed to the fixing frame 202 beside one side of the pulley set 204 far away from the pulley set 226, the steel rope 252 alternately connects the pulleys of the pulley set 238 and the pulley set 204 from the pulley 228, which is closest to the front end 254 of the steel rope 252, by using the front end 254 of the steel rope 252 as a beginning, and a rear end 256 of the steel rope 252 is connected to the reel region 268 of the rotary wheel 264, i.e. the steel rope 252 is extended downward to connect the pulley 228 from the fixing frame 202, next upward to connect the pulley 206, then downward to connect the pulley 230, subsequently upward to connect the pulley 208, next downward to connect the pulley 232, then upward to connect the pulley 210, downward to connect the pulley 234, upward to connect the pulley 212, downward to connect the pulley 236 and subsequently upward to connect the pulley 214, and then the rear end 256 of the steel rope 252 is connected to the reel region 268 of the rotary wheel 264.

Similarly, the pulley set 226, the pulley set 250 and the rotary wheel 264 are connected by the steel rope 258, in which the steel rope 258 has a plastic cover. A front end 260 of the steel rope 258 is fixed to the fixing frame 202 beside one side of the pulley set 226 far away from the pulley set 204, the steel rope 258 alternately connects the pulleys of the pulley set 250 and the pulley set 226 from the pulley 240, which is closest to the front end 260 of the steel rope 258, by using the front end 260 of the steel rope 258 as a beginning, and a rear end 262 of the steel rope 258 is connected to the reel region 270 of the rotary wheel 264, i.e. the steel rope 258 is extended downward to connect the pulley 240 from the fixing frame 202, next upward to connect the pulley 216, then downward to connect the pulley 242, subsequently upward to connect the pulley 218, next downward to connect the pulley 244, then upward to connect the pulley 220, downward to connect the pulley 246, upward to connect the pulley 222, downward to connect the pulley 248 and subsequently upward to connect the pulley 224, and then the rear end 262 of the steel rope 258 is connected to the reel region 270 of the rotary wheel 264. Both the steel rope 252 and the steel rope 258 can drive the rotary wheel 264 to hoist or descend the elevator 200.

Each of the pulley set 204, the pulley set 238, the pulley set 226 and the pulley set 250 includes five pulleys, so the steel rope 252 is divided into ten hoisting portions between the pulley set 204 and the pulley set 238, and the steel rope 258 is divided into ten hoisting portions between the pulley set 226 and the pulley set 250. The load of the elevator 200 are equally shared out between the ten hoisting portions of the steel rope 252 and the ten hoisting portions of the steel rope 258, so that the gravity load and the pulling force of the steel rope 252 and the steel rope 258 can be greatly decreased, and the torque force of the rotary wheel 264 can be reduced, thereby effectively increasing a safety factor of the elevator 200.

In an embodiment, diameters of the steel rope 252 and the steel rope 258 are about 3/16 inch, the load-carrying limitation of each hoisting portion of the steel rope 252 and the steel rope 258 is up to 475 kilograms, and there are twenty hoisting portions in the elevator 200 to share the whole carrying load, so each steel rope of the present embodiment can bear a load of 4750 kilograms, and the pulley apparatus can bear a total of 9500 kilograms. Provided that a 320-kilogram load is carried, and the amount weight of the pulley set 204, the pulley set 226, the pulley set 238 and the pulley set 250, the carriage 272 and the rotary wheel 264 is 100 kilograms, that is the pulley apparatus has to bear a total load of 420 kilograms, the safety factor of the elevator 200 will be over 10 times by only one steel rope.

In the present invention, in every rising or descending of the elevator 200, the two steel ropes work simultaneously. When one of the steel ropes of the elevator 200 is snapped by accident in working, the other of the steel rope can bear the whole weight to keep working, so as to temporarily insure safety of the elevator 200.

It should be noted that the amount of the pulley sets in the present embodiment is not limited to the aforementioned description and can be adjusted according to practical needs, the upper pulley sets and the lower pulley sets must have the same amount, and the upper pulley sets and the lower pulley sets are corresponding to each other.

According to the aforementioned description, one advantage of the present invention is that because the elevator in the present invention includes a plurality of series connected pulley sets, the gravity load and the pulling force of a steel rope can be decreased, and the rotary torque force of a rotary wheel of the elevator can be reduced.

According to the aforementioned description, another advantage of the present invention is that a rotary wheel, a carriage and pulley sets installed on the carriage are integrated, so that the whole carrying load of the elevator can be absorbed by the rotary wheel.

According to the aforementioned description, a further advantage of the present invention is that a rotary wheel of the elevator includes a reverse-proof device and a hand brake device, and the elevator is of a multi-lines hoisting design, so that when one of the steel ropes is snapped, the other of the steel ropes can work separately to further enhance the safety.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. An elevator, comprising:

a first upper pulley set, wherein the first upper pulley set comprises a plurality of first upper pulleys installed side by side in a fixing frame;

a second upper pulley set located beside one side of the first upper pulley set, wherein the second upper pulley set comprises a plurality of second upper pulleys installed side by side in the fixing frame;

a carriage located below the first upper pulley set and the second upper pulley set;

a first lower pulley set corresponding to the first upper pulley set, wherein the first lower pulley set comprises a plurality of first lower pulleys installed side by side on a top of the carriage, and the amount of the first lower pulleys is the same with that of the first upper pulleys;

a second lower pulley set located beside the first lower pulley set and corresponding to the second upper pulley set, wherein the second lower pulley set comprises a plurality of second lower pulleys installed side by side on the top of the carriage, and the amount of the second lower pulleys is the same with that of the second upper pulleys;

a rotary wheel installed in the carriage, wherein the carriage comprises a partition member to divide the rotary wheel into a first reel region and a second reel region;

a first steel rope connecting the first upper pulleys, the first lower pulleys and the rotary wheel, wherein one end of the first steel rope is fixed to the fixing frame beside the other side of the first upper pulley set, the first steel rope alternately connects the first lower pulleys and the first upper pulleys from the closest one of the first lower pulleys by using the end of the first steel rope as a beginning, and the other end of the first steel rope is connected to the first reel region of the rotary wheel; and a second steel rope connecting the second upper pulleys, the second lower pulleys and the rotary wheel, wherein one end of the second steel rope is fixed to the fixing frame beside one side of the second upper pulley set far away from the first upper pulley set, the second steel rope alternately connects the second lower pulleys and the second upper pulleys from the closest one of the second lower pulleys by using the end of the second steel rope as a beginning, and the other end of the second steel rope is connected to the second reel region of the rotary wheel.

2. The elevator according to claim 1, wherein the rotary wheel comprises a reverse-proof device.

3. The elevator according to claim 1, wherein the rotary wheel comprises a hand brake device.

4. The elevator according to claim 1, wherein each of the first steel rope and the second steel rope Includes a plastic cover.

5. The elevator according to claim 1, wherein the carriage comprises a movable door.

6. An elevator, comprising:

a plurality of upper pulley sets installed side by side in a fixing frame, wherein each of the upper pulley sets comprises a plurality of upper pulleys installed side by side in the fixing frame;

a carriage located below the upper pulley sets;

a plurality of lower pulley sets installed side by side on a top of the carriage, wherein the locations and the amount of the lower pulley sets are corresponding to the locations and the amount of the upper pulley sets, each of the lower pulley sets comprises a plurality of lower pulleys installed side by side on the top of the carriage, and the amount of the lower pulleys of each lower pulley set is the same with that of the upper pulleys of the corresponding upper pulley set;

a rotary wheel installed in the carriage, wherein the carriage comprises a plurality of partition members to divide the rotary wheel into a plurality of reel regions and the amount of the reel regions is the same with that of the upper pulley sets; and a plurality of steel ropes respectively corresponding to the upper pulley sets and the lower pulley sets, and the amount of the steel ropes is the same with that of the upper pulley sets, wherein each of the steel ropes connects the corresponding upper pulley set, the corresponding lower pulley set and the rotary wheel, one end of each steel rope is fixed to the fixing frame beside one side of the corresponding upper pulley set, each steel rope alternately connects the lower pulleys of the corresponding lower pulley set and the upper pulleys of the corresponding upper pulley set from the closest one of the lower pulleys of the corresponding lower pulley set by using the end of each steel rope as a beginning, and the other end of each steel rope is connected to the corresponding reel region of the rotary wheel.

7. The elevator according to claim 6, wherein the rotary wheel comprises a reverse-proof device.

8. The elevator according to claim 6, wherein the rotary wheel comprises a hand brake device.

9. The elevator according to claim 6, wherein each of the steel ropes includes a plastic cover.

10. The elevator according to claim 6, wherein the carriage comprises a movable door.

* * * * *